United States Patent [19]

Burton et al.

[11] Patent Number: 4,800,472

[45] Date of Patent: Jan. 24, 1989

[54] BATTERY-POWERED LAMP

[75] Inventors: Colin R. Burton, Wolverhampton; Philip Davies, London, both of United Kingdom

[73] Assignee: Ever Ready Limited, London, England

[21] Appl. No.: 114,160

[22] Filed: Oct. 27, 1987

[30] Foreign Application Priority Data

Oct. 27, 1986 [GB] United Kingdom ..... 8625647

[51] Int. Cl.[4] ..... F21L 9/00; F21Y 31/02

[52] U.S. Cl. ..... 362/158; 362/189

[58] Field of Search ..... 362/158, 189, 208, 202, 362/204, 267, 310

[56] References Cited

U.S. PATENT DOCUMENTS

| | | | |
|---|---|---|---|
| 2,296,287 | 9/1942 | Leyde | 362/158 X |
| 2,299,035 | 10/1942 | Rothenberg et al. | 362/158 |
| 2,410,535 | 11/1946 | Van Daalen | 362/158 |
| 2,427,017 | 9/1947 | Miller | 362/158 |
| 2,483,819 | 10/1949 | Falge | 362/158 |
| 2,832,968 | 5/1958 | Knudsen | 362/158 X |
| 2,837,630 | 6/1958 | Shen | 362/158 |
| 2,897,345 | 7/1959 | Meager et al. | 362/158 |
| 4,244,011 | 10/1981 | Hammel et al. | 362/208 X |
| 4,472,766 | 9/1984 | Hung | 362/158 |
| 4,531,178 | 7/1985 | Uke | 362/158 |

FOREIGN PATENT DOCUMENTS

| | | |
|---|---|---|
| 1168408 | 10/1969 | United Kingdom . |
| 1561508 | 2/1980 | United Kingdom . |
| 2091863 | 8/1982 | United Kingdom . |

*Primary Examiner*—Ira S. Lazarus
*Assistant Examiner*—Richard R. Cole
*Attorney, Agent, or Firm*—Richard D. Weber

[57] ABSTRACT

A battery powered lamp includes a two-part rigid casing comprising a hollow body with an end cap removably attached to the body and a water impermeable sock of flexible resilient material designed to fully enclose the body and partially enclose the end cap. The sock includes an annular rib trapped between the body and its attached cap.

7 Claims, 2 Drawing Sheets

BATTERY-POWERED LAMP

TECHNICAL FIELD

This invention relates to a battery-powered lamp clad in a water-impermeable resilient layer to proof the electrical components of the lamp against the ingress of unpressurised water and desirably to maintain that waterproofing in the face of a pressure of a few tens of centimetres of water.

DISCUSSION OF PRIOR ART

It is known to provide a battery-powered torch with a rigid inner casing, in or on which are mounted the electrical components, and to enclose the inner casing in a moulded-on layer of a resilient water-impermeable coating such as rubber. At least one end of the casing is provided with a removable end cap to allow access to the interior of the casing and it is the connecting region(s) between the end cap(s) and the remainder of the casing which is/are most likely to allow the passage of water, thereby destroying the waterproof properties of the torch. The or each cap can be screw-threadedly engaged on the rest of the casing and the moulded-on layers confronting at each connecting region can thereby be pressed one against the other to improve the water seal between them, but the seal(s) so produced is/are not necessarily reliably formed. Further, moulding the coating in situ on the rigid casing and its end cap(s) is an expensive operation not conducive to mass production techniques.

SUMMARY OF THE INVENTION

According to the present invention, a battery-powered lamp comprises a two-part rigid casing comprising a hollow body and an end cap removably attached to the body and a water-impermeable sock of flexible resilient material designed to fully enclose the body and partially enclose the end cap, the sock including an annular rib trapped between the body and its attached cap.

Desirably, the end cap incorporates the light-generating and beam-defining members of the lamp (e.g. a tungsten filament bulb, a reflector and a lamp "glass") and the body of the casing incorporates the on/off switch arrangement exposed on the surface thereof where it can be actuated through the sock by a user of the lamp.

Conveniently the end cap is screw-threadedly attached to the body of the casing, the annular rib of the sock being trapped between an end of a screw-threaded flange on the end cap and an annular shoulder on the body of the casing.

Suitably the rib and the casing components that trap it in place, are shaped so that there is a force applied to the rib, as the cap is fixed in place on the body, which is radially inwardly directed with respect to the casing.

The body of the casing can be injection moulded from a rigid plastics material, the cap can be injection moulded from a rigid transparent plastics material and the sock can be of moulded rubber.

BRIEF DESCRIPTION OF THE DRAWINGS

One embodiment of hand lamp in accordance with the invention will now be described, by way of example, with reference to the accompanying drawings, in which.

DESCRIPTION OF PREFERRED EMBODIMENTS

Figure 1:
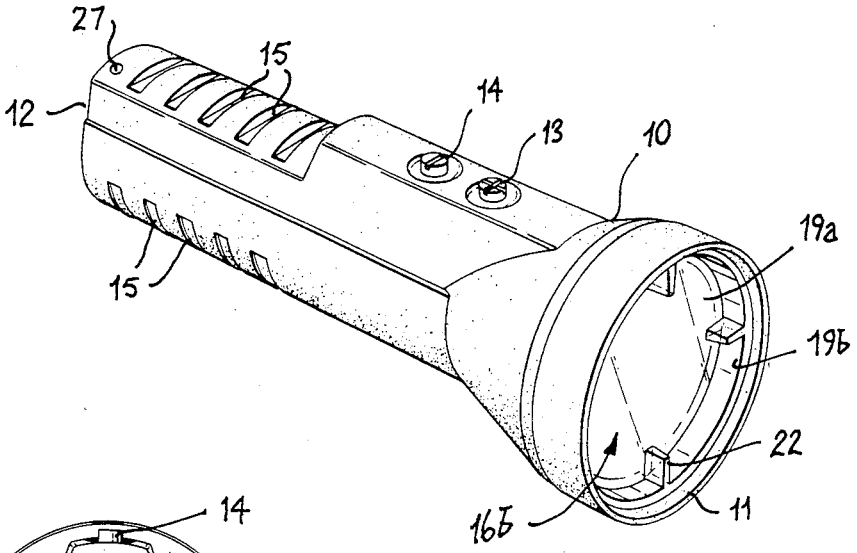
FIG. 1 shows a front perspective view of the assembled lamp.
Figure 2:
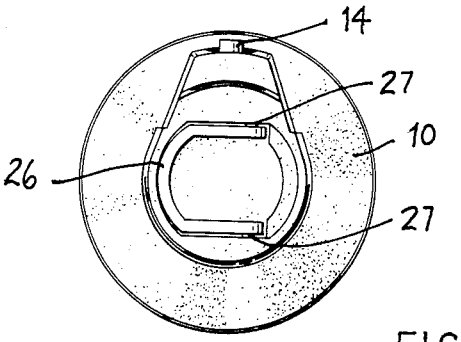
FIG. 2 an end view of the lamp.

The hand lamp shown in the drawings comprises a one-piece rubber sock 10 open at the beam end 11 and closed at the other end 12. On the surface of the sock, operating buttons 13, 14 are moulded as are grooves 15 to improve hand grip in use of the lamp. The buttons 13, 14 are mere surface features on the rubber sock but each is positioned to overlie a respective electrical switch means (not shown) on a casing 16 of the lamp. One of the buttons (13) acts to switch the lamp on and the other (14) acts to switch the lamp off. On/off arrangements of this type are well known in hand lamps and will not be further described here.

Located within the sock 10 is the rigid casing 16 (which contains the necessary batteries 17) and is made of a tubular body **16*a* and an end cap 16*b*. The body 16*a* closely conforms to the shape of the interior of the sock 10 and provides rigidity to the latter. In the region 18 adjacent to the open end of the body 16*a*, the latter has a frusto-conical shape and includes an annular shoulder 18*a* and a screw-threaded skirt 18*b***.

The end cap **16*b* includes a transparent front "glass" 19*a* and a generally cylindrical rim 19*b*, the rim 19*b* being internally screw-threaded to mesh with the skirt 18*b* when the casing 16 is closed. Supported within the end cap 16*b* is a reflector 20 and an electric bulb 21. Four ridges 22 extending inwardly from the rim 19*b* at 90° intervals provide finger supports enabling the removal of the end cap 16*b*** when required.

Figure 4:
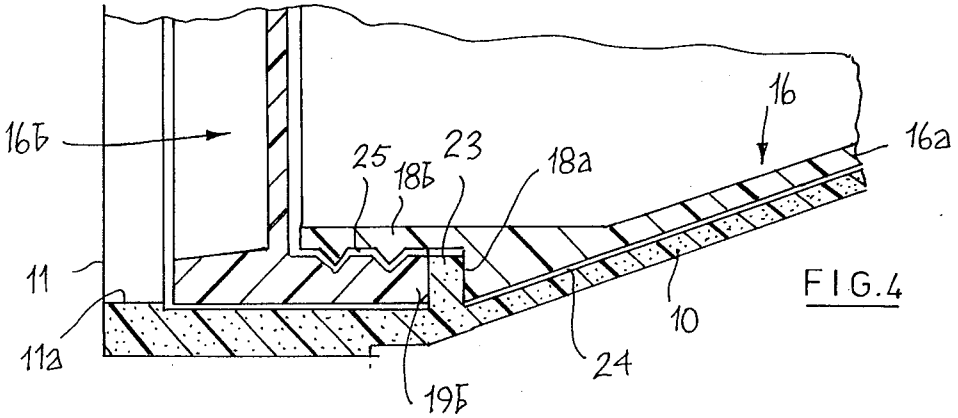
FIG. 4 is an enlarged sectional view of the region where the waferproof seal is effected.

FIG. 4 shows the essential construction of the lamp which affords a high degree of waterproofing. The sock 10 is provided with an annular rib 23 spaced at just such a distance from the beam end 11 that it overlies the shoulder **18*a*. Thus when the end cap 16*b* is screwed onto the body 16*a* to close the latter, the rib 23 is compressed between the shoulder 18*a* and the rim 19*b* forming a complete seal preventing ingress of water past the shoulder 18*a* into a narrow gap 24 between the body 16*a* and the sock 10 beyond the rib 23 and also preventing ingress of water into the interior of the casing 16 via a gap 25 between the skirt 18*b* and the rim 19*b***.

The beam end 11 of the sock 10 can be thickened somewhat (as shown at **11*a* in FIG. 4**) to improve the shock resistance of the lamp. The lamp shown can be dropped from one metre onto a vinyl-tile covered concrete floor without damage.

Figure 5:
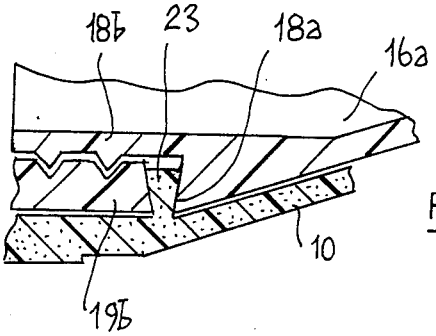
FIG. 5 is a view of a modified form of seal.
Figure 3:
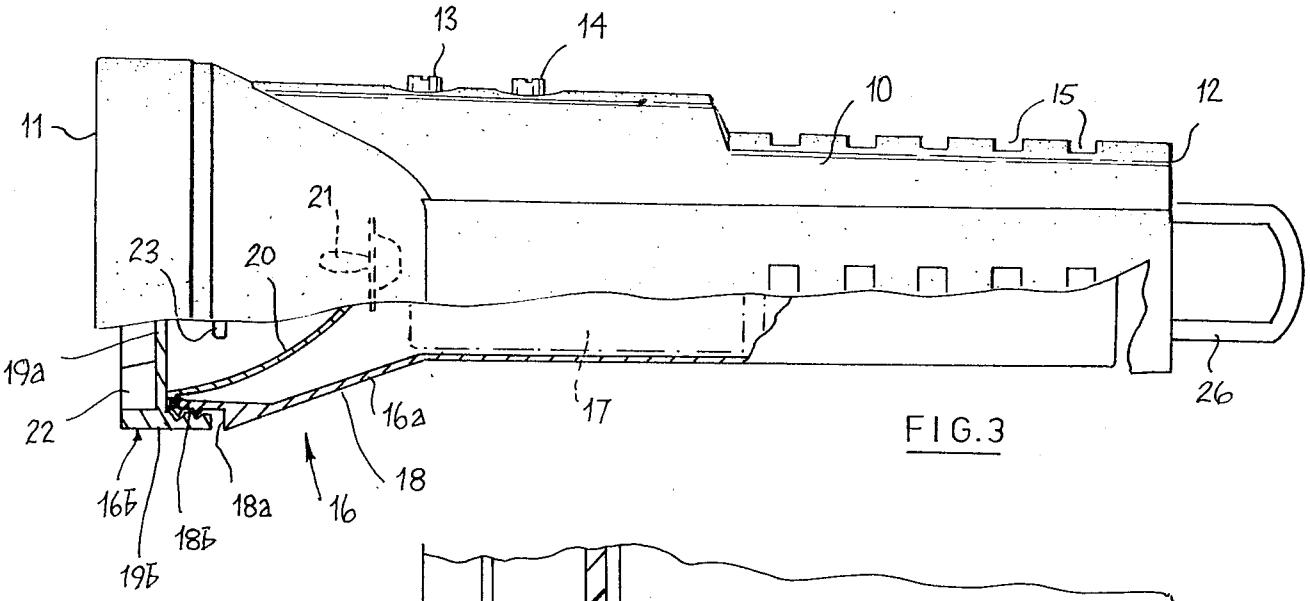
FIG. 3 shows a side view partially broken away to show some interior components.

To generate a radially inwardly directed force on the rib 23 as it is compressed between the shoulder **18*a* and the rim 19*b*, the latter can be angled slightly (as shown in FIG. 5) and the rib 23** can be wedge shaped so that it gets thicker in the radially inward direction.

A handle 26 is pivotally mounted on the end 12 of the sock 10 about pivot pins 27.

What is claimed is:

1. A battery powered lamp including a two-part rigid casing comprising a hollow body and an end cap removably attached to the body, and a water-impermeable sock of flexible resilient material closed at one end and open at the other end and designed to fully enclose the body and partially enclose the end cap, the sock including an annular rib projecting inwardly of the sock at a position spaced from the open end thereof, the rib being wedge-shaped so that it thickens in the radially inward direction and being trapped between the body and its attached cap, the casing components that trap the rib in place, being shaped so that there is a force applied to the wedge-shaped rib, as the cap is fixed in place on the body, which is radially inwardly directed with respect to the casing, the portion of the sock between the rib and the open end thereof surrounding the cap and extending beyond the cap.

2. A battery powered lamp as claimed in claim 1, in which the end cap incorporates the light-generating and beam-defining members of the lamp and the body of the casing incorporates an on/off switch arrangement exposed on the surface thereof where it can be actuated through the sock by a user of the lamp.

3. A battery powered lamp as claimed in claim 2, in which the end cap is screw-threadedly attached to the body of the casing, the annular rib of the sock being trapped between an end of a screw-threaded flange on the end cap and an annular shoulder on the body of the casing, said end and said shoulder diverging in the radially inward direction of the body to coact with the wedge-shaped rib and generate the inwardly directed force.

4. A battery powered lamp as claimed in claim 3, in which the body of the casing is injection moulded from a rigid plastics material and the cap is injection moulded from a rigid transparent plastics material.

5. A battery powered lamp as claimed in claim 4, in which the sock is of moulded rubber.

6. A battery powered lamp as claimed in claim 1, in which the sock is thickened where it extends beyond the cap to improve the shock resistance of the lamp.

7. A battery powered lamp as claimed in claim 1, in which the end cap includes a transparent front glass, a generally cylindrical rim and ridges extending inwardly from the rim to provide supports enabling removal of the end cap when required.

* * * * *